United States Patent [19]

Arai et al.

[11] 4,088,596

[45] May 9, 1978

[54] METHOD OF TREATING DRAINS

[75] Inventors: Haruhiko Arai, Narashino; Yumio Nakasone, Sakura, both of Japan

[73] Assignee: Kao Soap Co., Ltd., Tokyo, Japan

[21] Appl. No.: 758,958

[22] Filed: Jan. 13, 1977

[30] Foreign Application Priority Data

Feb. 27, 1976 Japan ..... 51-21388
Jun. 15, 1976 Japan ..... 51-70499

[51] Int. Cl.[2] ..... C11D 7/56; C11D 7/18

[52] U.S. Cl. ..... 252/99; 252/95; 252/186; 134/2; 134/22 C

[58] Field of Search ..... 252/95, 96, 99, 186; 134/2; 136/22 R, 22 C

[56] References Cited

U.S. PATENT DOCUMENTS 3,697,431 10/1972 Summerfelt ..... 134/2 X

*Primary Examiner*—Mayer Weinblatt
*Attorney, Agent, or Firm*—Blanchard, Flynn, Thiel, Boutell & Tanis

[57] ABSTRACT

A drain cleaner composition comprising an inorganic peroxide has a high cleaning effect and is suitable for cleaning drainpipes, traps, filter pipes and the like. This composition does no harm to human bodies and it can be stored and used with safety, and it does not exert a corrosive action on metallic pipes and other metallic objects. The cleaning effect of this composition is enhanced when a heat-treated inorganic peroxide is used or when a surface active agent is used in combination with the inorganic peroxide.

33 Claims, No Drawings

METHOD OF TREATING DRAINS

BACKGROUND OF THE INVENTION

1. FIELD OF THE INVENTION

The present invention relates to a cleaning composition for drainpipes, traps, filter pipes and the like.

2. DESCRIPTION OF THE PRIOR ART

Clogged or slow-running drains frequently occur in commercial and residential buildings because of the accumulation of various waste materials therein. More specifically, various food wastes, excrements, bathroom residues and soap scale, hair, paper articles and other fibrous articles accumulate in and cause clogging or slow drainage of wastes through drainpipes, traps and filter pipes of kitchens, lavatories, bathrooms and the like.

As conventional procedures for removing these accumulated wastes from drainpipes, traps, filter pipes, etc., there can be mentioned the following methods:

1. A method in which a highly alkaline substance, such as sodium hydroxide or potassium hydroxide, is placed into a drainpipe or the like, optionally together with aluminum chips, and is dissolved in water. The solid waste materials that cause the clogging are dissolved or at least freed from adhering contact with the pipe, by the heat and the hydrogen gas generated by dissolution of the cleaning chemical (see, for example, U.S. Pat. No. 3,471,407).

2. A method in which a strong acid, such as sulfuric acid, hydrochloric acid, nitric acid, orthophosphoric acid or sulfamic acid, is used as the cleaning chemical (see, for example, U.S. Pat. No. 3,538,008 and Japanese Patent Publication No. 31724/73).

3. A method in which the dissolving and emulsifying actions of a chlorinated hydrocarbon and a surfactant are utilized (see, for example, U.S. Pat. No. 3,553,145).

4. A method in which dirt and fibers are decomposed and solubilized by using enzymes and microorganisms (see, for example, Japanese Patent Publication No. 26465/63).

5. A method in which the injection pressure of an aerosol propellant is utilized to physically dislodge the clog.

6. A method in which the pipes are disassembled and the dirt and clogging materials are physically removed therefrom.

These conventional methods, however, are insufficient for various reasons. For example, the cleaning chemicals used in the methods (1) and (2) have a very vigorous chemical action, and therefore, they are very dangerous not only during the cleaning operation but also during storage. Further, they readily corrode drainpipes made of metals. Methods (3) and (4) were developed as procedures for overcoming the defects of methods (1) and (2), but a fully satisfactory cleansing effect cannot be attained by these methods (3) and (4). The method (5) can be applied to cleaning of completely clogged pipes, but it is not effective for cleaning partially clogged pipes in which running of water is inhibited to some extent or a bad smell is caused by dirt or fibers deposited and accumulated on the inner walls of pipes. The method (6) is very troublesome and cannot be performed simply.

SUMMARY OF THE INVENTION

It is, therefore, a primary object of the present invention to provide a cleaning composition for drainpipes which can overcome the foregoing defects of conventional cleaning agents for drainpipes and which has a high cleaning effect and shows a very high safety not only during the cleaning operation but also during storage.

In accordance with one aspect of the present invention, there is provided a cleaning composition for drainpipes comprising from 25 to 100% by weight of an inorganic peroxide.

in accordance with another aspect of the present invention, there is provided a cleaning composition for drainpipes comprising, as critical components, an inorganic peroxide and a surface active agent.

DETAILED DESCRIPTION OF THE PREFERRED EMBODIMENTS

The cleansing composition for drainpipes according to the present invention comprises from 25 to 100% by weight of an inorganic peroxide.

In the present invention, as the inorganic peroxide, there are preferably employed sodium perborate ($NaBO_3.4H_2O_2$) (hereinafter referred to as "PB"), sodium percarbonate ($Na_2CO_3.3/2H_2O_2$) (hereinafter referred to as "PC"), and a hydrogen peroxide adduct of sodium sulfate ($4Na_2SO_4.NaCl.-2H_2O_2$) (hereinafter referred to as "PS"). In addition, there can be employed, for example, a hydrogen peroxide adduct of sodium silicate ($Na_2SiO_3.3H_2O_2$), a hydrogen peroxide adduct of sodium pyrophosphate ($Na_4P_2O_7.nH_2O_2$, $n = 1, 2$ or 3) and a hydrogen peroxide adduct of sodium orthophosphate ($Na_3PO_4.4H_2O_2.2H_2O$ or $Na_3PO_4.9/2H_2O_2$). When these inorganic peroxides are heat-treated (under the conditions described hereinafter), their effects are further improved. Heat-treated PC (heat-treated sodium percarbonate) is very stable, has a sufficient oxidizing activity even at low temperatures and possesses an excellent oxygen-generating property. Accordingly, heat-treated PC is most perferred among the inorganic peroxides.

As pointed out hereinbefore, in accordance with another aspect of the present invention, there is provided a cleaning composition for drainpipes comprising as indispensable components an inorganic peroxide, such as those mentioned above, and a surface active agent.

The kind of surface active agent used in combination with the inorganic peroxide is not particularly critical in the present invention. Any of the water-soluble organic surface active agents customarily used as ingredients of houshold cleaning compositions, such as laundry detergents, can be used in the present invention. The surface active agents that can be used in the present invention include anionic surface active agents, non-ionic surface active agents, amphoteric surface active agents and cationic surface active agents.

As the anionic surface active agent, there can be mentioned, for example, fatty acid soaps ($C_8$ to $C_{20}$), linear and branched long-chain alkyl sulfate salts, linear and branched alkylaryl ($C_{14}$ to $C_{18}$) sulfonate salts, long-chain alkane sulfonate salts, long chain $\alpha$-olefine sulfonate salts, polyoxyethylene long-chain alkyl ether sulfate salts, polyoxyethylene long-chain alkylphenyl ether sulfate salts, and $\alpha$-sulfo-fatty acid ($C_8$ to $C_{20}$) salts. As the counter cation of the anionic surface active agent, there can be mentioned, for example, alkali metal ions, ammonium ions and alkylol-substituted ammonium ions such as diethanolamine.

The non-ionic surface active agents that can be used in the present invention include polyoxyethylene long-chain alkyl ethers, polyoxyethylene long-chain alkylphenyl ethers, fatty acid ($C_8$ to $C_{22}$) sorbitan esters, fatty acid ($C_8$ to $C_{22}$) sugar ethers, fatty acid ($C_8$ to $C_{22}$) lower alkyl ($C_1$ to $C_4$) esters, polyoxyethylene glycerin fatty acid ($C_8$ to $C_{22}$) esters and long-chain alkylamine-ethylene oxide adducts.

The amphoteric surface active agents that can be used in the present invention include long-chain alkyl betaines and long-chain alkyl sulfobetaines.

The cationic surface active agents that can be used in the present invention include long-chain mono- and dialkyl ammonium salts and long-chain 2-alkyl-2-imidazoline derivatives. As the counter anion of the cationic surface active agent, there can be mentioned halogen ions and lower alkyl ($C_1$ to $C_2$)-substituted sulfonic acid ions.

The term "long-chain" used hereinabove, means a chain containing from 8 to 22 carbon atoms. The term "polyoxyethylene" used hereinabove means that the number of moles of added ethylene oxide units is in the range of from 1 to 30 .

The preferred surface active agents are anionic surface active agents and non-ionic surface active agents. Especially preferred anionic surface active agents are alkali metal α-olefin sulfonates (having 10 to 18 carbon atoms), alkali metal polyoxyethylene alkyl ether sulfates (the carbon number of the alkyl group is in the range of from 10 to 14 and the mole number of added ethylene oxide units is in the range of from 2 to 6), alkali metal linear alkyl benzenesulfonates (having 10 to 14 carbon atoms in the alkyl group) and alkali metal alkyl sulfates (having 10 to 18 carbon atoms in the alkyl group). Especially preferred non-ionic surface active agents are polyoxyethylene alkyl ethers (the carbon number of the alkyl group is in the range of from 10 to 14 and the mole number of added ethylene oxide units is in the range of from 2 to 30) and polyoxyethylene alkyl phenyl ethers (the carbon number of the alkyl group is in the range of from 6 to 12 and the mole number of added ethylene oxide units is in the range of from 2 to 30).

When the surface active agent is used in combination with the inorganic peroxide, the amount of the inorganic peroxide is ordinarily from 10 to 99% by weight, preferably 25 to 80% weight, more preferably 35 to 70% by weight. The amount of the surface active agent is ordinarily 0.5 to 70% by weight, preferably 2 to 55% by weight, more preferably 10 to 40% by weight. Of course, these ingredients may be incorporated in amounts outside the above ranges, but in this case, in order to attain a sufficient cleaning effect, a larger amount of the cleaning composition must be used, resulting in an economic disadvantage.

The mechanism by which the inorganic peroxide exerts an excellent cleaning effect for drainpipes has not been completely elucidated. However, it is believed that the inorganic peroxide that is used in the present invention will generate oxygen of the nascent state in water and this nascent oxygen will denature or destroy the adhesive slime that causes the dirt or fibers to adhere to the drainpipe because of the bleaching action (oxidizing action) of the oxygen and will thus exert an excellent cleaning effect. Further, a gas of oxygen molecules generated in the water rise therein the form of fine bubbles, and it is considered that these rising fine bubbles also will be effective for decomposing and separating dirt and fibers adhering to untouchable parts of the inner walls of drainpipes. In the cleaning composition of the present invention, these fine bubbles have an important role in attaining the cleaning effect. It is preferred that the cleaning composition of the present invention shall have an appropriate bubble-forming property. From this standpoint, the use of an inorganic peroxide having a bubbling property enhanced by the heat treatment is especially preferred.

The heat treatment is ordinarily accomplished by heating a powdery inorganic peroxide at 70° to 250° C, preferably 100° to 130° C, for several hours, preferably 0.5 to 2 hours. This heat treatment is described in Japanese Patent Publication No. 8976/69 and Japanese Patent Application Laid-Open Specification No. 70286/75. When the inorganic peroxide is thus heat-treated, from about 5 to about 20% of the total effective oxygen is decomposed so as to exist as oxygen in the composition, and some of the thus-formed oxygen molecules are confined in the crystal grains of the peroxide and cause vigorous bubbling when the peroxide is dissolved in water. Such bubbling property can also be attained by reacting sodium hydrogencarbonate with an acid, but in this case, the bubbles thereby generated are carbon dioxide gas bubbles and although a mechanical dirt-removing effect can be attained, no chemical (oxidizing) activity can be expected.

The inorganic peroxide is incorporated in an amount of from 25 to 100% by weight, preferably 35 to 100% by weight, into the cleaning composition for drainpipes according to the present invention. If the amount incorporated of the inorganic peroxide is too small, a satisfactor cleaning effect cannot be attained.

It is considered that the surface active agent will exert effects of promoting permeation of the active cleaning component (inorganic peroxide) into the dirt and fibers, promoting wetting of the dirt and fibers by the active cleaning component, dispersing and emulsifying the removed dirt and fibers, and preventing re-contamination of the washed surfaces by the removed dirt and fibers.

The cleaning composition of the present invention can further comprise, in addition to the above-mentioned inorganic peroxide and surface active agent, other additives according to need, including from 0.1 to 15% by weight of a chelating agent for preventing precipitation of insoluble matters formed by reaction of the active cleaning component with polyvalent metal ions and from 0.1 to 25% by weight of an activator for promoting the oxidizing action of the inorganic peroxide. Moreover, small amounts of an alkaline agent for enhancing the washing power, finely divided silica for rendering the composition powdery and an extender selected from alkali metal sulfates, carbonates, silicates, borates and halides and minor amounts of perfumes and dyes for increasing the commercial value can be incorporated into the cleaning composition of the present invention.

The cleaning composition for drainpipes according to the present invention comprises an inorganic peroxide as an active cleaning component and therefore, in general, it is in the solid state. The composition can be used in a powdery form or after it has been molded into tablets or the like.

The cleaning composition for drainpipes according to the present invention is very safe to human bodies and has no corrosive action on metallic objects and the like, not only during the cleaning operation but also during storage, and it has a very high cleaning effect as illustrated in the Examples given hereinafter.

The present invention will now be described in more detail by reference to the following illustrative Examples that do not limit the scope of the invention.

EXAMPLE 1

A synthetic specimen drainpipe dirt was prepared in the following manner:

Namely, 100 g of soap powder, 50 g of soybean oil, 50 g of rapeseed oil and 100 g of liquid paraffin were well blended in 10 Kg of hard water having a DH value of 100, and the resulting solution was circulated in a transparent polyvinyl chloride hose having an inner diameter of 1.2 cm by using a circulation pump. When circulation was continued for 5 to 6 hours, it was seen that the specimen dirt was deposited on the entire surface of the inner wall of the polyvinyl chloride hose. The dirt adhered so tightly to the inner wall that it could scarcely be removed by water washing. The hose was cut into pieces having a suitable length and was subjected to the cleaning test using the various cleaning compositions described below.

| Cleaning Composition for Drainpipes According to The Present Invention: | | |
|---|---|---|
| Composition 1: | | |
| Heat-treated PC | 100% | by weight |
| Composition 2: | | |
| Heat-treated PB | 50% | " |
| Sodium alkyl benzene-sulfonate (average alkyl chain length = 12 carbon atoms) | 25% | " |
| Finely divided silica | 25% | " |
| Composition 3: | | |
| PC | 50% | " |
| Polyoxyethylene (8 moles) alkyl ether (average alkyl chain length = 12 carbons) | 30% | " |
| Glucose pentaacetate (activating agent for PC) | 20% | " |
| Composition 4: | | |
| Heat-treted PS | 50% | " |
| Polyoxyethylene (8 moles) alkyl ether (average alkyl chain length = 12 carbons) | 25% | " |
| Sodium ethylenediamine tetra-acetate | 5% | " |
| Fine divided silica | 20% | " |
| Comparative Cleaning Compositions for Drainpipes: | | |
| Comparative Composition A: | | |
| Strong alkali (sodium hydroxide) | 40% | by weight |
| Metallic aluminum chips | 60% | " |
| Comparative Composition B: | | |
| Strong acid (sulfamic acid) | 37% | " |
| Sodium carbonate | 17% | " |
| Sodium sulfate | 43% | " |
| Water | 3% | " |
| Comparative Composition C: | | |
| Chlorinated hydrocarbon (1,1,1-trichloroethane) | 97% | " |
| Surface active agent (polyoxyethylene alkyl phenyl ether) | 3% | " |
| Comparative Composition D: | | |
| Enzyme plus microorganism | | |

One opening of the above soiled hose, cut into a suitable length, was plugged with a rubber stopper, and the cleaning composition and water (the cleaning composition concentration was adjusted to be 5 wt.%) were poured into the hose from the other end. Then, the hose was set in a test-tube stand. The degree of removal of the model dirt as examined at prescribed time intervals. During the experiment, no physical force was applied to the interior of the hose. The results obtained are shown in Table 1.

Table 1

| Cleaning Composition | Time Elapsed | | | |
|---|---|---|---|---|
| | 2 hours | 4 hours | 8 hours | 14 hours |
| 1 | X | ○ | ◎ | — |
| 2 | ◎ | — | — | — |
| 3 | ○ | ◎ | — | — |
| 4 | ○ | ◎ | — | — |
| A | ○ | ◎ | — | — |
| B | X | ○ | ◎ | — |
| C | X | X | X | X |
| D | X | X | X | X |

Notes:
◎ : substantially completely removed (at least 95% of the total area of the inner wall was cleaned)
○ : considerably removed (15 to 95% of the total area of the inner wall became clean)
X : hardly removed (less than 15% of the total area of the inner wall became clean)
— : dirt was completely removed and hence, the experiment was discontinued.

EXAMPLE 2

The specimen dirt described in Example 1 was deposited on stainless steel pieces, and the soiled pieces were dipped in an aqueous solution of a cleaning composition indicated below (concentration = 5%, temperature 20° C) and the degree of removal of the dirt was examined based on the weight change. The time required for removing 50% of the deposited dirt was measured. The results obtained are shown below:

Composition 2 (same as in Example 1): 80 minutes
Composition 3 (same as in Example 1): 100 minutes
Compositon A (same as in Example 1): 110 minutes
Composition B (same as in Example 1): more than 300 minutes

EXAMPLE 3

A mixture comprising 20% of calcium stearate, 20% of calcium oleate, 40% of rapeseed oil and 20% of silica (sand) capable of passing through a 200-mesh sieve was kneaded in a mortar, and 0.5% of the kneaded mixture was uniformly coated on one surface of a glass sheet (26 mm × 38 mm). The glass sheet contaminated with this specimen dirt was suspended in a beaker and dipped in an aqueous composition containing 10% of a cleaning composition as indicated in Table 2. The ratio of the dirt-removed area was examined at prescribed intervals. The results obtained are shown in Table 3.

Table 2

| Composition No. | Mixing Ratios (wt.%) of Components in Cleaning Compositions | | | | Remarks |
|---|---|---|---|---|---|
| | Heat-Treated PC | Polyoxyethylene (8 moles) Alkyl Ether (average alkyl chain length = $C_{12}$) | Finely Divided Silica | Sodium Sulfate | |
| 5 | 0 | 30 | 30 | 40 | comparison |
| 6 | 5 | 30 | 30 | 35 | " |
| 7 | 10 | 30 | 30 | 30 | " |
| 8 | 15 | 30 | 30 | 25 | " |
| 9 | 20 | 30 | 30 | 20 | " |
| 10 | 25 | 30 | 30 | 15 | present invention |
| 11 | 30 | 30 | 30 | 10 | " |
| 12 | 40 | 30 | 30 | 0 | " |

Table 3

| Percentage of Dirt-Free Area After Dipping for Specified Times | | | | |
|---|---|---|---|---|
| Cleansing Composition | 1 hour | 2 hours | 4 hours | 8 hours |
| 5 | 0 | 0 | 0 | 0 |
| 6 | 0 | 5–10 | 10–15 | 10–15 |
| 7 | 0 | 5–10 | 15–20 | 15–20 |
| 8 | 0 | 10–15 | 20–25 | 20–25 |
| 9 | 5–10 | 15–20 | 30–40 | 45–55 |
| 10 | 5–10 | 25–30 | 60–70 | 80–90 |
| 11 | 10–15 | 30–35 | 70–80 | 90–100 |
| 12 | 15–20 | 45–50 | 80–90 | 95–100 |
| A (same as in Example 1) | 5–10 | 20–25 | 45–50 | 70–80 |
| B (same as in Example 1) | 0 | 5–10 | 5–10 | 10–15 |

Example 4

Composition 13:
Heat-treated PC: 50%
Sodium sulfate: 49%
Perfume: 1%
This composition shows a good cleaning property.

EXAMPLE 5

Composition 14:
Heat-treated PB: 95%
Glucose penta-acetate: 4%
Perfume: 1%
This composition shows a good cleaning property.

EXAMPLE 6

Composition 15:
PC: 70%
Sodium tripolyphosphate: 20%
Sodium sulfate: 9%
Perfume 1%
This composition shows a good cleaning property.

EXAMPLE 7

Composition 16:
Heat-treated Ps: 40%
Sodium carbonate: 20%
Glucose penta-acetate: 2%
Sodium ethylenediamine tetra-acetate: 10%
Sodium sulfate: 28%
This composition shows a good cleaning property.

EXAMPLE 8

Composition 17:
Heat-treated PC: 30%
PS: 25%
Sodium ethylenediamine tetra-acetate: 15%
Sodium chloride: 30%
This composition shows a good cleaning property.

EXAMPLE 9

A specimen drainpipe dirt was prepared in the following manner:

Namely, 100 g of powder soap, 50 g of soybean oil, 50 g of rapeseed oil and 100 g of liquid paraffin were well blended in 10 Kg of hard water having a DH value of 100, and the resulting solution was circulated in a transparent polyvinyl chloride hose having an inner diameter of 1.2 cm by using a circulation pump. When circulation was continued for 5 to 6 hours, it was seen that the model dirt was deposited on the entire surface of the inner wall of the polyvinyl chloride hose. The dirt adhered so tightly to the inner wall that it could scarcely be removed by water washing. The hose was cut into pieces having a suitable length and was subjected to the cleaning test using various cleaning compositions as described below.

| Cleaning Compositions for Drainpipes According to the Present Invention | |
|---|---|
| Composition 18: | |
| Heat-treated PC | 50 % |
| Polyoxyethylene alkyl ether (average alkyl chain length = 12C, added ethylene oxide mole number = 8) | 50 % |
| Composition 19: | |
| PB | 40 % |
| Sodium alkyl benzene-sulfonate (average alkyl chain length = 12C) | 30 % |
| Finely divided hydrous silica | 30 % |
| Composition 20: | |
| Heat-treated PS | 40 % |
| Polyoxyethylene (8 moles) alkyl ether (average alkyl chain length = 12C) | 30 % |
| Sodium ethylenediamine tetra-acetate | 5 % |
| Finely divided hydrous silicon dioxide | 25 % |
| Composition 21: | |
| Heat-treated PC | 40 % |
| Polyoxyethylene (12 moles) alkyl ether (average alkyl chain length = 12C) | 6 % |
| Polyoxyethylene (8 moles) alkyl ether (average alkyl chain length = 12C) | 4 % |
| Sodium tripolyphosphate | 10 % |
| Finely divided silicon dioxide | 10 % |
| Sodium sulfate | 30 % |
| Composition 22: | |
| Heat-treated PC | 100 % |
| Composition 23 (comparison): | |
| Polyoxyethylene (8 moles) alkyl ether (average alkyl chain length = 12C) | 50 % |
| Sodium alkyl benzene-sulfonate (average alkyl chain length = 12C) | 50 % |

In the same manner as described in Example 1, the degree of removal of the dirt was examined. During the experiment, no physical force was applied to the interior of the hose. The results obtained are shown in Table 4.

Table 4

| Degree of Removal of Dirt after Passage of Certain Time | | | | |
|---|---|---|---|---|
| Cleaning Composition | Time Elapsed | | | |
| | 2 hours | 4 hours | 8 hours | 14 hours |
| 18 | ◎ | — | — | — |
| 19 | ○ | ◎ | — | — |
| 20 | ○ | ◎ | — | — |
| 21 | ○ | ◎ | — | — |
| 22 | X | ○ | ◎ | — |
| 23 (comparison) | X | X | ○ | ○ |

EXAMPLE 10

The specimen dirt described in Example 1 was deposited on stainless steel pieces, and the soiled pieces were dipped in an aqueous solution of a cleaning composition indicated below (concentration = 5%, temperature 20° C) and the degree of removal of the dirt was examined based on the weight change. The time required for removing 50% of the deposited dirt was measured. The results obtained are shown below:

Composition 18 (same as in Example 10): 80 minutes
Composition 20 (same as in Example 10): 100 minutes
Composition B (same as in Example 1): 228 minutes
Composition D (same as in Example 1): more than 300 minutes

EXAMPLE 11

A mixture comprising 20% of calcium stearate, 20% of calcium oleate, 40% of rapeseed oil and 20% of silica (sand) capable of passing through a 200-mesh sieve as kneaded in a mortar, and 0.5 g of the kneaded mixture was uniformly coated on one surface of a glass sheet (26 mm × 38 mm). The coated glass was allowed to stand overnight. The glass sheet contaminated with the specimen dirt was treated with a cleaning composition comprising 68% of heat-treated PC, 17% of a surface active agent shown in Table 5 and 15% of finely divided silicon dioxide. The ratio of the dirt-removed area was examined at prescribed intervals to obtain results shown in Table 5.

Table 5

| Sample No. | Surface Active Agent Combined with Heat-Treated PC | Percentage of Dirt-Free Area 2 hours | 4 hours |
|---|---|---|---|
| 1 | Blank (no surface active agent) | 0 | 15–20 |
| 2 | polyoxyethylene lauryl ether (P̄=5)* | 90–95 | 95–100 |
| 3 | polyoxyethylene lauryl ether (P̄=13) | 80–85 | 90–95 |
| 4 | polyoxyethylene lauryl ether (P̄=25) | 35–40 | 60–65 |
| 5 | polyoxyethylene oleyl ether (P̄=6) | 10–15 | 20–25 |
| 6 | polyoxyethylene oleyl ether (P̄=13) | 10–15 | 25–30 |
| 7 | polyoxyethylene nonyl phenyl ether (P̄=4) | 85–90 | 90–100 |
| 8 | polyoxyethylene nonyl phenyl ether (P̄=8) | 90–95 | 90–100 |
| 9 | polyoxyethylene nonyl phenyl ether (P̄=17) | 75–80 | 90–95 |
| 10 | sodium polyoxyethylene lauryl sulfate (P̄=3) | 70–75 | 90–95 |
| 11 | sodium linear alkyl benzene-sulfonate ($C_{12}$–$C_{14}$)** | 70–75 | 90–95 |
| 12 | sodium alkyl sulfate ($C_{12}$–$C_{14}$) | 65–70 | 80–85 |
| 13 | sodium α-olefin sulfonate ($C_{12}$–$C_{14}$) | 70–75 | 90–95 |
| 14 | lauryl trimethyl ammonium chloride | 10–15 | 20–25 |
| 15 | lauryl betaine | 10–20 | 25–30 |

*P̄ denotes the number of moles of added ethylene oxide units.
**derived from coconut oil.

EXAMPLE 12

A sample product having the composition described below was used in 21 houses troubled with bad smells from drainage openings or clogging of drainpipes in toilets, bathrooms, lavatories or kitchens. In each case, deposition of dirt and fibers was considerably advanced and putrefaction had already started in the deposited dirt and fibers.

Compositon 24:
Heat-treated PC: 35%
Polyoxyethylene (6 moles) lauryl ether: 30%
Finely divided hydrous silicon dioxide: 30%
Sodium ethylenediamine tetra-acetate: 5%
Perfume: minute amount Before going to sleep for the night, about 40 g of the above composition (powder) was placed into a drainage opening, and was flowed to the trap by adding a small amount of water. The next morning, water was allowed to run sufficiently and the pressure of a bad smell or the condition of water running was examined. The results obtained are shown in Table 6.

Table 6

| Place | Number of Houses: Bad smell was removed | Water running was improved | Uncertain | No effect |
|---|---|---|---|---|
| Lavatory | 0 | 0 | 1 | 0 |
| Bathroom | 7 | 1 | 2 | 1 |
| Kitchen | 3 | 2 | 0 | 0 |
| Toilet | 4 | 0 | 0 | 0 |

EXAMPLE 13

Composition 25:
Heat-treated PC 40%
Polyoxyethylene (9 moles) nonyl phenyl ether: 6%
finely divided silicon dioxide: 6%
Sodium tripolyphosphate: 18%
Sodium sulfate: 30%

Composition 26:
Heat-treated PC: 25%
Sodium polyoxyethylene (3 moles) alkyl ether sulfate (average alkyl chain length = 12c): 20%
Finely divided silicon dioxide: 20%
Sodium sulfate: 35%

Composition 27:
Heat-treated PC: 35%
Sodium alkyl sulfate (average alkyl chain length = 12C): 30%
Glucose penta-acetate: 0.5%
Sodium tripolyphosphate: 20%
Sodium chloride: 14%
Perfume: 0.5%

Composition 28:
Heat-treated PB: 45%
Polyoxyethylene (8 moles) alkyl ether (average alkyl chain length = 12C): 15%
Lauryl betaine: 10%
Finely divided hydrous silicon dioxide: 10%
Sodium carbonate: 19%
Perfume: 1%

Composition 29:
Heat-treated PS: 50%
Polyoxyethylene (12 moles) alkyl ether (average alkyl chain length = 12C): 20%
Lauryl trimethyl ammonium chloride: 9%
Finely divided hydrous silicon dioxide: 20%
Perfume:

Composition 30:
Heat-treated PC 50%
Sodium alkyl sulfate (average alkyl chain length = 12): 10%
Glucose penta-acetate: 0.5%
Sodium tripolyphosphate: 20%
Sodium chloride 19%
Perfume 0.5%

Each of the foregoing compositions 25 to 30 was found to be a good cleaning agent for drainpipes.

The drain cleaning composition normally is packaged in the form of a free-flowing powder or granules. In use, after removing any free-standing water from the slow running or clogged drain, an appropriate amount of the cleaning composition is deposited into the drain and a small quantity of water is added to move the cleaning composition to the location of the blockage and to dissolve the cleaning agent so that its chemical action can begin. Such treatment can be repeated, according to need. The amount of the cleaning composition used will depend on the size of the drain and the character of the blockage therein. In general, the mode of using the inorganic peroxide drain cleaning composition, according to the invention, is the same as the conventional mode of using the prior art highly alkaline drain cleaners (method (1) above).

The embodiments of the invention in which an exclusive property or privilege is claimed are defined as follows:

1. A method of treating clogged, slow running or bad-smelling drains, which comprises the steps of: depositing in said drain an effective amount of a drain cleaner composition consisting essentially of an inorganic peroxide selected from the group consisting of sodium perborate, sodium percarbonate, $4Na_2SO_4.NaCl.2H_2O_2$, $Na_2SiO_3.3H_2O_2$, $Na_4P_2O_7.nH_2O_2$ wherein $n$ is 1, 2 or 3, $Na_3PO_4.4H_2O_2.2H_2O$ and $Na_3PO_4.9/2H_2O_2$.

2. A method as claimed in claim 1 in which said inorganic peroxide is selected from the group consisting of sodium perborate, sodium percarbonate and $4Na_2SO_4.NaCl.2H_2O_2$.

3. A method as claimed in claim 2 in which said inorganic peroxide has been heat treated at from 70° to 250° C for from 0.5 to 2 hours.

4. A method as claimed in claim 2 in which said drain cleaner composition contains from 0.1 to 15% by weight of a chelating agent effective to prevent precipitation of insoluble substances formed by reaction of the composition with polyvalent metal ions.

5. A method as claimed in claim 2 in which said drain cleaner composition contains from 0.1 to 25% by weight of an activator for promoting the oxidizing action of said inorganic peroxide.

6. A method as claimed in claim 3 in which said inorganic peroxide is sodium percarbonate.

7. A method of treating clogged, slow running or bad-smelling drains, which comprises the steps of: depositing in said drain an effective amount of a drain cleaner composition consisting essentially of from 25 to 100% by weight of an inorganic peroxide selected from the group consisting of sodium perborate, sodium percarbonate, $4Na_2SO_4.NaCl.2H_2O_2$, $Na_2SiO_3.3H_2O_2$, $Na_4P_2O_7.nH_2O_2$ wherein $n$ is 1, 2 or 3, $Na_3PO_4.4H_2O_2.2H_2O$ and $Na_3Po_4.9/2H_2O_2$, and the balance is essentially water-soluble organic surface active agent.

8. A method as claimed in claim 7 in which said inorganic peroxide is selected from the group consisting of sodium perborate, sodium percarbonate and $4Na_2SO_4.NaCl.2H_2O_2$.

9. A method as claimed in claim 8 in which said inorganic peroxide has been heat treated at from 70° to 250° C for from 0.5 to 2 hours.

10. A method as claimed in claim 8 in which said drain cleaner composition contains from 25 to 80% by weight of said inorganic peroxide.

11. A method as claimed in claim 8 in which said drain cleaner composition contains from 35 to 70% by weight of said inorganic peroxide.

12. A method as claimed in claim 8 in which said drain cleaner composition contains from 0.1 to 15% by weight of a chelating agent effective to prevent precipitation of insoluble substances formed by reaction of said composition with polyvalent metal ions.

13. A method as claimed in claim 8 in which said drain cleaner composition contains from 0.1 to 25% by weight of an activator for promoting the oxidizing action of said inorganic peroxide.

14. A method as claimed in claim 9 in which said inorganic peroxide is sodium percarbonate.

15. A method according to claim 10 in which said water-soluble organic surface active agent is selected from the group consisting of 1. anionic surface active agents selected from the group consisting of fatty acid soaps ($C_8$ to $C_{20}$), linear and branched long-chain alkyl ($C_8$ to $C_{22}$) sulfate salts, linear and branched alkylaryl ($C_{14}$ to $C_{18}$) sulfonate salts, long-chain alkane ($C_8$ to $C_{22}$) sulfonate salts, long-chain α-olefin ($C_8$ to $C_{22}$) sulfonate salts, polyoxyethylene long-chain alkyl ($C_8$ to $C_{22}$) ether sulfate salts containing 1 to 30 moles of ethylene oxide, polyoxyethylene long-chain alkyl ($C_8$ to $C_{22}$) phenyl ether sulfate salts containing 1 to 30 moles of ethylene oxide and α-sulfo fatty acid ($C_8$ to $C_{20}$) salts,
2. nonionic surface active agents selected from the group consisting of polyoxyethylene long-chain alkyl ($C_8$ to $C_{22}$) ethers containing 1 to 30 moles of ethylene oxide, polyoxyethylene long-chain alkyl ($C_8$ to $C_{22}$)-phenyl ethers containing 1 to 30 moles of ethylene oxide, fatty acid ($C_8$ to $C_{22}$) sorbitan ethers, fatty acid ($C_8$ to $C_{22}$) sugar ethers, fatty acid ($C_8$ to $C_{22}$) lower alkyl ($C_1$ to $C_4$) esters, polyoxyethylene glycerin fatty acid ($C_8$ to $C_{22}$) esters containing 1 to 30 moles of ethylene oxide and long-chain alkyl ($C_8$ to $C_{22}$) amine ethylene oxide adducts,
3. amphoteric surface active agents selected from the group consisting of long-chain alkyl ($C_8$ to $C_{22}$) betaines and long-chain akyl ($C_8$ to $C_{22}$) sulfobetaines, and
4. cationic surface active agents selected from the group consisting of long-chain mono- and dialkyl ($C_8$ to $C_{22}$) quaternary ammonium salts and long-chain 2-alkyl ($C_8$ to $C_{22}$)-2-imidazoline derivatives.

16. A method according to claim 10 wherein the surface active agent is a member selected from the group consisting of polyoxyethylene alkyl ethers in which the carbon number of the alkyl group is in the range of from 10 to 14 and the number of moles of added ethylene oxide is in the range of from 2 to 30, polyoxyethylene alkylphenyl ethers in which the carbon number of the alkyl group is in the range of from 6 to 12 and the number of moles of added ethylene oxide is in the range of from 2 to 30, alkali metal α-olefin sulfonates having 10 to 18 carbon atoms, alkali metal polyoxyethylene alkyl ether sulfates in which the carbon number of the alkyl group is in the range of from 10 to 14 and the number of moles of added ethylene oxide is in the range of from 2 to 6, alkali metal linear alkylbenzene sulfonates having 10 to 14 carbon atoms in the alkyl group and alkali metal alkyl sulfates having 10 to 18 carbon atoms in the alkyl group.

17. A method according to claim 16 in which said drain cleaner composition contains from 35 to 70% by weight of said inorganic peroxide and from 10 to 40% by weight of said surface active agent.

18. A method of treating clogged, slow running or bad-smelling drains, which comprises the step of depositing in said drain a drain cleaner composition consisting essentially of from 25 to 100% by weight of an inorganic peroxide selected from the group consisting of sodium perborate, sodium percarbonate, $4Na_2SO_4.NaCl.2H_2O_2$, $Na_2SiO_3.3H_2O_2$, $Na_4P_2O_7.nH_2O_2$ wherein $n$ is 1, 2 or 3, $Na_3PO_4.4H_2O_2.2H_2O$ and $Na_3PO_4.9/2H_2O_2$, and the balance is silica, alkali metal sulfates, alkali metal carbonates, alkali metal silicates, alkali metal borates, alkali metal halides, alkali metal phosphates or mixtures thereof.

19. A method as claimed in claim 18 in which said inorganic peroxide is selected from the group consisting of sodium perborate, sodium percarbonate and $4Na_2SO_4.NaCl.2H_2O_2$.

20. A method as claimed in claim 19 in which said inorganic peroxide has been heat treated at from 70° to 250° C for from 0.5 to 2 hours.

21. A method as claimed in claim 19 in which said drain cleaner composition contains from 0.1 to 15% by weight of a chelating agent effective to prevent precipitation of insoluble substances formed by reaction of the composition with polyvalent metal ions.

22. A method as claimed in claim 19 in which said drain cleaner composition contains from 0.1 to 25% by weight of an activator for promoting the oxidizing action of said inorganic peroxide.

23. A method as claimed in claim 20 in which said inorganic peroxide is sodium percarbonate.

24. A method of treating clogged, slow running or bad-smelling drains, which comprises the step of: depositing in said drain an effective amount of a drain cleaner composition consisting essentially of from 25 to 80% by weight of an inorganic peroxide selected from the group consisting of sodium perborate, sodium percarbonate, $4Na_2SO_4.NaCl.2H_2O_2$, $Na_2SiO_3.3H_2O_2$, $Na_4P_2O_7.nH_2O_2$ wherein $n$ is 1, 2 or 3, $Na_3PO_4.4H_2O_2.2H_2O$ and $Na_3PO_4.9/2H_2O_2$, from 2 to 55% by weight of water-soluble organic surface active agent and the balance is essentially silica, alkali metal sulfates, alkali metal carbonates, alkali metal silicates, alkali metal borates, alkali metal halides, alkali metal phosphates or mixtures thereof.

25. A method as claimed in claim 24 in which said inorganic peroxide is selected from the group consisting of sodium perborate, sodium percarbonate and $4Na_2SO_4.NaCl.2H_2O_2$.

26. A method as claimed in claim 25 in which said inorganic peroxide has been heat treated at from 70° to 250° C for from 0.5 to 2 hours.

27. A method as claimed in claim 25 containing from 35 to 70% by weight of said inorganic peroxide and from 10 to 40% by weight of said surface active agent.

28. A method as claimed in claim 25 in which said drain cleaner composition contains from 0.1 to 15% by weight of a chelating agent effective to prevent precipitation of insoluble cubstances formed by reaction of the composition with polyvalent metal ions.

29. A method as claimed in claim 25 in which said drain cleaner composition contains from 0.1 to 25% by weight of an activator for promoting the oxidizing action of said inorganic peroxide.

30. A method according to claim 25 in which said water-soluble organic surface active agent is selected from the group consisting of 1. anionic surface active agents selected from the group consisting of fatty acid soaps ($C_8$ to $C_{20}$), linear and branched long-chain alkyl ($C_8$ to $C_{22}$) sulfate salts, linear and branched alkylaryl ($C_{14}$ to $C_{18}$) sulfonate salts, long-chain alkane ($C_8$ to $C_{22}$) sulfonate salts, long-chain $\alpha$-olefin ($C_8$ to $C_{22}$) sulfonate salts, polyoxyethylene long-chain alkyl ($C_8$ to $C_{22}$) ether sulfate salts containing from 1 to 3 moles of ethylene oxide, polyoxyethylene long-chain alkyl ($C_8$ to $C_{22}$) phenyl ether sulfate salts containing from 1 to 3 moles of ethylene oxide and $\alpha$-sulfo fatty acid ($C_8$ to $C_{20}$) salts,
2. nonionic surface active agents selected from the group consisting of polyoxyethylene long-chain alkyl ($C_8$ to $C_{22}$) ethers containing from 1 to 3 moles of ethylene oxide, polyoxyethylene long-chain alkyl ($C_8$ to $C_{22}$) phenyl ethers containing from 1 to 3 moles of ethylene oxide, fatty acid ($C_8$ to $C_{22}$) sorbitan esters, fatty acid ($C_8$ to $C_{22}$) sugar ethers, fatty acid ($C_8$ to $C_{22}$) lower alkyl ($C_1$ to $C_4$) esters, polyoxyethylene glycerin fatty acid ($C_8$ to $C_{22}$) esters containing from 1 to 3 moles of ethylene oxide and long-chain alkyl ($C_8$ to $C_{22}$) amine ethylene oxide adducts,
3. amphoteric surface agents selected from the group consisting of long-chain alkyl ($C_8$ to $C_{22}$) betaines and long-chain alkyl ($C_8$ to $C_{22}$) sulfobetaines, and
4. cationic surface active agents selected from the group consisting of long-chain mono- and dialkyl($C_8$ to $C_{22}$) quaternary ammonium salts and long-chain 2-alkyl ($C_8$ to $C_{22}$)-2-imidazoline derivatives.

31. A method as claimed in claim 26 in which said inorganic peroxide is sodium percarbonate.

32. A metal according to claim 27 wherein the surface active agent is a member selected from the group consisting of polyoxyethylene alkyl ethers in which the carbon number of the alkyl group is in the range of from 10 to 14 and the number of moles of added ethylene oxide is in the range of from 2 to 30, polyoxyethylene alkylphenyl ethers in which the carbon number of the alkyl group is in the range of from 6 to 12 and the number of moles of added ethylene oxide is in the range of from 2 to 30, alkali metal $\alpha$-olefin sulfonates having 10 to 18 carbon atoms, alkali metal polyoxyethylene alkyl ether sulfonates in which the carbon number of the alkyl group is in the range of from 10 to 14 and the number of moles of added ethylene oxide is in the range of from 2 to 6, alkali metal linear alkylbenzene sulfonates having 10 to 14 carbon atoms in the alkyl group and alkali metal alkyl sulfates having 10 to 18 carbon atoms in the alkyl group.

33. A method according to claim 32 in which the balance of the composition is essentially silica, sodium sulfate, sodium tripolyphosphate, sodium carbonate, sodium chloride or mixture thereof.

* * * * *

UNITED STATES PATENT AND TRADEMARK OFFICE

CERTIFICATE OF CORRECTION

PATENT NO. : 4 088 596

DATED : May 9, 1978

INVENTOR(S) : Haruhiko Arai et al

It is certified that error appears in the above-identified patent and that said Letters Patent are hereby corrected as shown below:

Column 11, line 20; change "steps" to ---step---.

Column 11, line 27; change "$Po_4$" to ---$PO_4$---.

Column 12, line 7; change "ethers" to ---esters---.

Column 13, line 31; change "preciptation" to ---precipitation---.

Column 13, line 32; change "cubstances" to ---substances---.

Column 14, line 17; change "surface agents" to ---surface active agents---.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*